METHOD FOR SEPARATING A MIXTURE OF MOLTEN OXIDIZED FERROPHOSPHORUS AND REFINED FERROPHOSPHORUS

This application is a continuation of our prior U.S. application Ser. No. 752,880, filed Dec. 20, 1976, now abandoned.

The present invention is directed to the separation of a molten mixture of oxidized ferrophosphorus and refined ferrophosphorus by contacting a free-falling stream of the molten mixture with a jet of water which is substantially aligned with the longitudinal axis of an inclined collecting trough.

Ferrophosphorus is a by-product of phosphorus manufacture and crude ferrophosphorus contains about 20 to 30% by weight phosphorus, 50 to 60% by weight iron, 2 to 9% by weight vanadium, up to about 8% by weight chromium, silicon, titanium, and nickel. The manufacture of phosphorus and the production of ferrophosphorus is described in U.S. Pat. Nos. 3,305,355, 3,154,410, and 3,699,213. While by-product crude ferrophosphorus has some direct industrial uses, such as noted in the above-mentioned patents, oxidized ferrophosphorus containing about 40% by weight or more $P_2O_5$ is useful for pyrometallurgical purposes. Oxidized ferrophosphorus is obtained by subjecting molten crude ferrophosphorus to oxidizing conditions whereby a molten product mixture is continuously obtained which contains molten oxidized ferrophosphorus and molten refined ferrophosphorus, the vanadium, chromium, silicon and titanium being concentrated in the oxidized ferrophosphorus phase as described in U.S. patent application, Ser. No. 568,983.

It is important to provide efficient separation of the oxidized ferrophosphorus phase from the refined ferrophosphorus phase so that these materials can be used directly in various metallurgical operations.

Since the oxidized ferrophosphorus and refined ferrophosphorus have distinct physical properties, e.g., density, ferromagnetism, it has been a practice to cast the molten mixture of these materials into ingots and thereafter fracture the ingots, the fracturing causes separation of the intermetallic refined ferrophosphorus phase from the glassy, slag-like oxides and ferrophosphorus phase. The respective phases are subsequently crushed to a desired size for industrial use.

The foregoing separation practice has obvious disadvantages such as being inherently a discontinuous operation and requiring large crushing equipment.

It is therefore an object of the present invention to provide an efficient process for continuously separating a molten mixture of oxidized ferrophosphorus and refined ferrophosphorus into its respective phases.

Figure 1:
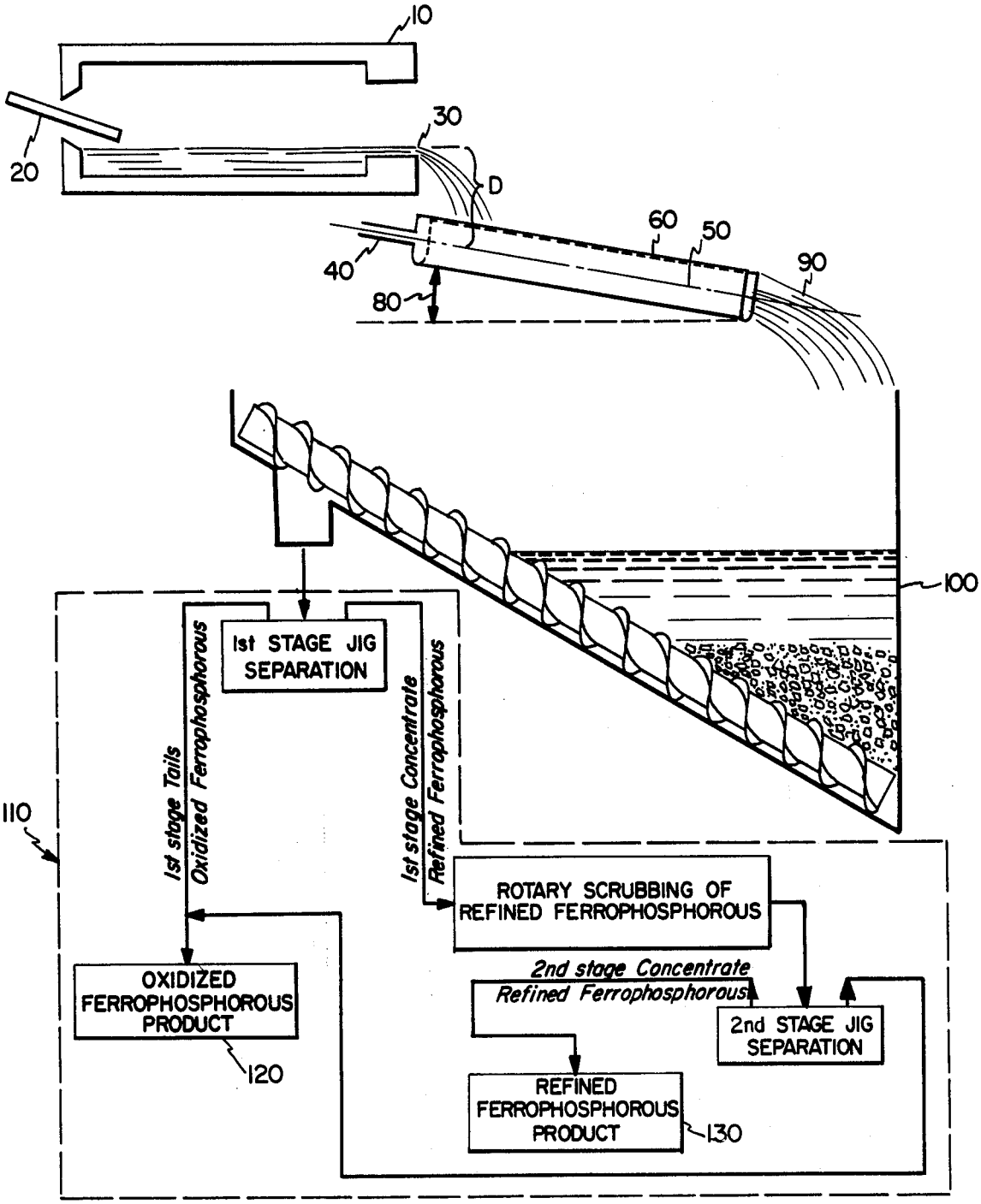
Figure 2:
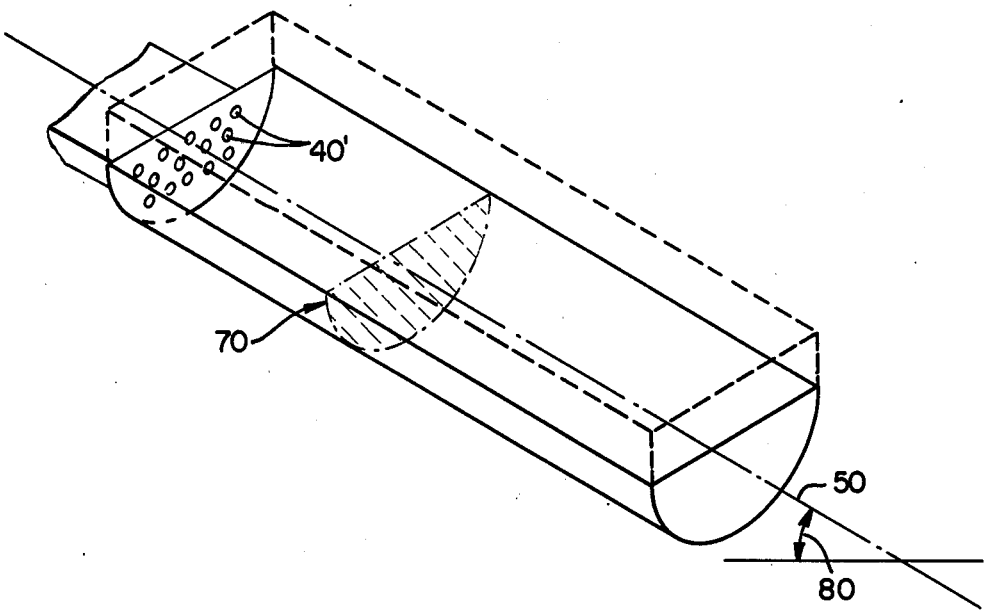

Other objects will be apparent from the following description and claims taken in conjunction with the drawing wherein FIG. 1 shows, somewhat schematically, a particular embodiment of the present invention and FIG. 2 shows the trough of FIG. 1 in somewhat more detail.

A method in accordance with the present invention for separating a molten mixture of oxidized ferrophosphorus and refined ferrophosphorus comprises (i) providing a free-falling stream of a molten mixture of oxidized ferrophosphorus and refined ferrophosphorus, said stream falling from a height of up to five feet toward an elongated trough inclined to the horizontal at an angle of between about 25° and 45° and (ii) passing said molten stream through at least one jet of water which is substantially in alignment with the longitudinal axis of said trough, said jet of water having a velocity of from about 20 to 40 feet per second, the ratio by weight of water to said molten stream being from about 10:1 to 20:1.

The present invention will be more fully understood with reference to FIG. 1 and FIG. 2. FIG. 1 shows at 10 an oxidizing vessel into which crude ferrophosphorus and oxygen are introduced via conduit 20, the crude ferrophosphorus being converted into a mixture of oxidized ferrophosphorus and refined ferrophosphorus which exits as a molten stream indicated at 30, e.g., at a temperature of from 1300° to 1550° C. The molten stream 30 falls freely through a distance D and is contacted by a jet of water from nozzle 40, the jet of water being substantially in alignment with the longitudinal axis 50 of trough 60. The water jet, of a plurality of jets, should be arranged so that the full width of the falling molten stream, transverse to axis 50, is exposed to the water jet or jets to achieve shotting of the molten stream and transfer of the shotted product along trough 60. The longitudinal axis 50 passes through substantially the geometric center of the effective cross-section 70 of trough 60, shown in FIG. 2, i.e., the cross-section required to contain the water-shotted solids mixture which is carried through trough 60. The velocity of the jet of water from nozzle 40, which can be a plurality of nozzles as shown in FIG. 2, is important and should be in the range of about 20 to 40 feet per second, while the distance D should be about 1 to 5 feet. The incline of the trough 60, as indicated at angle 80 should be from 25° to 45° , preferably about 30° . Also, the weight ratio of water to molten material should be from about 10:1 to 20:1. Under the aforedescribed conditions, the molten mixture of oxidized ferrophosphorus and refined ferrophosphorus is solidified and shotted and granulated by the impact and contact of the water jet or jets and at least 80% by weight of the solid material exiting trough 60 at 90 is sized from about ¼ inch to 100 mesh (U.S. Screen Series) and is in the form of essentially individual particles of either shotted relatively high density intermetallic refined ferrophosphorus or shattered fragments of oxidized ferrophosphorus slag-like material. There is no danger of explosions due to entrapped water during the course of the process described hereinabove and the process can be practiced continuously. The sizing of the solid material is satisfactory for ultimate separation of the phases by conventional mineral jigging techniques using apparatus of the type described in The Chemical Engineers Handbook, 3rd Edition, 1950 - McGraw-Hill. Also conventional magnetic separation techniques can be used in view of the different ferromagnetic properties of oxidized ferrophosphorus and refined ferrophosphorus. FIG. 1 shows the solids from trough 60 being transferred from collecting unit 100 to a conventional jigging and scrubbing arrangement 110 which results in recovery of oxidized ferrophosphorus product at 120 and refined ferrophosphorus product at 130.

The following example will further illustrate the present invention.

EXAMPLE

A molten stream of oxidized ferrophosphorus and refined ferrophosphorus at a temperature of 1385° to 1425° C. was permitted to free-fall from a height of

METHOD FOR SEPARATING A MIXTURE OF MOLTEN OXIDIZED FERROPHOSPHORUS AND REFINED FERROPHOSPHORUS

This application is a continuation of our prior U.S. application Ser. No. 752,880, filed Dec. 20, 1976, now abandoned.

The present invention is directed to the separation of a molten mixture of oxidized ferrophosphorus and refined ferrophosphorus by contacting a free-falling stream of the molten mixture with a jet of water which is substantially aligned with the longitudinal axis of an inclined collecting trough.

Ferrophosphorus is a by-product of phosphorus manufacture and crude ferrophosphorus contains about 20 to 30% by weight phosphorus, 50 to 60% by weight iron, 2 to 9% by weight vanadium, up to about 8% by weight chromium, silicon, titanium, and nickel. The manufacture of phosphorus and the production of ferrophosphorus is described in U.S. Pat. Nos. 3,305,355, 3,154,410, and 3,699,213. While by-product crude ferrophosphorus has some direct industrial uses, such as noted in the above-mentioned patents, oxidized ferrophosphorus containing about 40% by weight or more $P_2O_5$ is useful for pyrometallurgical purposes. Oxidized ferrophosphorus is obtained by subjecting molten crude ferrophosphorus to oxidizing conditions whereby a molten product mixture is continuously obtained which contains molten oxidized ferrophosphorus and molten refined ferrophosphorus, the vanadium, chromium, silicon and titanium being concentrated in the oxidized ferrophosphorus phase as described in U.S. patent application, Ser. No. 568,983.

It is important to provide efficient separation of the oxidized ferrophosphorus phase from the refined ferrophosphorus phase so that these materials can be used directly in various metallurgical operations.

Since the oxidized ferrophosphorus and refined ferrophosphorus have distinct physical properties, e.g., density, ferromagnetism, it has been a practice to cast the molten mixture of these materials into ingots and thereafter fracture the ingots, the fracturing causes separation of the intermetallic refined ferrophosphorus phase from the glassy, slag-like oxides and ferrophosphorus phase. The respective phases are subsequently crushed to a desired size for industrial use.

The foregoing separation practice has obvious disadvantages such as being inherently a discontinuous operation and requiring large crushing equipment.

It is therefore an object of the present invention to provide an efficient process for continuously separating a molten mixture of oxidized ferrophosphorus and refined ferrophosphorus into its respective phases.

Other objects will be apparent from the following description and claims taken in conjunction with the drawing wherein FIG. 1 shows, somewhat schematically, a particular embodiment of the present invention and FIG. 2 shows the trough of FIG. 1 in somewhat more detail.

A method in accordance with the present invention for separating a molten mixture of oxidized ferrophosphorus and refined ferrophosphorus comprises (i) providing a free-falling stream of a molten mixture of oxidized ferrophosphorus and refined ferrophosphorus, said stream falling from a height of up to five feet toward an elongated trough inclined to the horizontal at an angle of between about 25° and 45° and (ii) passing said molten stream through at least one jet of water which is substantially in alignment with the longitudinal axis of said trough, said jet of water having a velocity of from about 20 to 40 feet per second, the ratio by weight of water to said molten stream being from about 10:1 to 20:1.

The present invention will be more fully understood with reference to FIG. 1 and FIG. 2. FIG. 1 shows at 10 an oxidizing vessel into which crude ferrophosphorus and oxygen are introduced via conduit 20, the crude ferrophosphorus being converted into a mixture of oxidized ferrophosphorus and refined ferrophosphorus which exits as a molten stream indicated at 30, e.g., at a temperature of from 1300° to 1550° C. The molten stream 30 falls freely through a distance D and is contacted by a jet of water from nozzle 40, the jet of water being substantially in alignment with the longitudinal axis 50 of trough 60. The water jet, of a plurality of jets, should be arranged so that the full width of the falling molten stream, transverse to axis 50, is exposed to the water jet or jets to achieve shotting of the molten stream and transfer of the shotted product along trough 60. The longitudinal axis 50 passes through substantially the geometric center of the effective cross-section 70 of trough 60, shown in FIG. 2, i.e., the cross-section required to contain the water-shotted solids mixture which is carried through trough 60. The velocity of the jet of water from nozzle 40, which can be a plurality of nozzles as shown in FIG. 2, is important and should be in the range of about 20 to 40 feet per second, while the distance D should be about 1 to 5 feet. The incline of the trough 60, as indicated at angle 80 should be from 25° to 45° , preferably about 30° . Also, the weight ratio of water to molten material should be from about 10:1 to 20:1. Under the aforedescribed conditions, the molten mixture of oxidized ferrophosphorus and refined ferrophosphorus is solidified and shotted and granulated by the impact and contact of the water jet or jets and at least 80% by weight of the solid material exiting trough 60 at 90 is sized from about ¼ inch to 100 mesh (U.S. Screen Series) and is in the form of essentially individual particles of either shotted relatively high density intermetallic refined ferrophosphorus or shattered fragments of oxidized ferrophosphorus slag-like material. There is no danger of explosions due to entrapped water during the course of the process described hereinabove and the process can be practiced continuously. The sizing of the solid material is satisfactory for ultimate separation of the phases by conventional mineral jigging techniques using apparatus of the type described in The Chemical Engineers Handbook, 3rd Edition, 1950 - McGraw-Hill. Also conventional magnetic separation techniques can be used in view of the different ferromagnetic properties of oxidized ferrophosphorus and refined ferrophosphorus. FIG. 1 shows the solids from trough 60 being transferred from collecting unit 100 to a conventional jigging and scrubbing arrangement 110 which results in recovery of oxidized ferrophosphorus product at 120 and refined ferrophosphorus product at 130.

The following example will further illustrate the present invention.

EXAMPLE

A molten stream of oxidized ferrophosphorus and refined ferrophosphorus at a temperature of 1385° to 1425° C. was permitted to free-fall from a height of about 1.5 feet into a trough similar to that shown in FIG. 2. The width of the molten stream transverse to the axis of the trough was about 0.5 to 1.5 inches and the flow rate of the molten stream was about 44.6 pounds per minute. The incline of the trough was about 30°.

The trough was semicircular in cross-section (5-inch radius) and was made of steel and was 2 feet long and 10 inches wide at the top. An array of 130 nozzles was provided in an arrangement similar to that shown in FIG. 2 and the water jets from the 7/64 inch diameter nozzles have a velocity of about 27 ft./second. The total water flow rate was about 110 gallons per minute. The molten stream was shotted by contact with the water jets and the resulting particles were swept through the trough by the water and transferred via communicating transport trough to a water containing collecting unit of the type shown in FIG. 1. The solid particles in the collecting unit were 95.2% sized between ¼ inch and 100 mesh. The particles larger than ¼ inch were separated by screening and crushed to finer than ¼ inch. All of the shotted solids except 181 pounds of fines (15.1% 100 M×D) were then transferred to a James Jig, single stage, bed size 10"×12", screen size 1/16", operating at a feed rate of about 12 lb./minute, a frequency of 2.9 seconds$^{-1}$, and an amplitude of 1/16".

The oxidized ferrophosphorus phase was separated from the refined ferrophosphorus phase. The following table shows the results obtained for an input to the jig of 3408 lb. of shotted material which was approximately 39.6% by weight refined ferrophosphorus.

TABLE I

| | JIG TEST RESULTS | |
|---|---|---|
| | Oxidized Ferrophosphorus | Refined Ferrophosphorus |
| Weight of Product | 2233 lb. | 1174 lb. |

TABLE I-continued

| | JIG TEST RESULTS | |
|---|---|---|
| | Oxidized Ferrophosphorus | Refined Ferrophosphorus |
| Recovered Size | 99.9% ¼" ×100M | 98.9% ¼" × 100M |
| Analysis | 35.4% $O_2$<br>6.91% $V_2O_5$ | 4.95% $O_2$<br>2.04% $V_2O_5$ |

What is claimed is:

1. Method for separating a molten mixture of oxidized ferrophosphorus and refined ferrophosphorus which comprises (i) providing a free-falling stream of a molten mixture of oxidized ferrophosphorus and refined ferrophosphorus, said stream falling from a height of about 1 up to five feet toward an elongated trough inclined to the horizontal at an angle of between about 25° and 45° and (ii) passing said free-falling molten mixture stream through an array of a plurality of jets of water which is substantially in alignment with the longitudinal axis of said trough such that the full width of the falling stream transverse to said longitudinal axis is exposed to said array to solidify and granulate said mixture and provide a mixture of individual solid particles of essentially oxidized ferrophosphorus with individual solid particles of essentially refined ferrophosphorus, at least 80% by weight of said particles being sized from ¼ inch to 100 mesh, each of said jets of water having a velocity of from about 20 to 40 feet per second, the ratio by weight of water to said molten stream being from about 10:1 to 20:1 and (iii) subsequently separating said particles of oxidized ferrophosphorus from said particles of refined ferrophosphorus.

2. Method in accordance with claim 1 wherein at least about 95% of said particles are sized from ¼ inch to 100 mesh.

* * * * *